US006917300B2

(12) United States Patent
Allen

(10) Patent No.: US 6,917,300 B2
(45) Date of Patent: Jul. 12, 2005

(54) METHOD AND APPARATUS FOR TRACKING OBJECTS AT A SITE

(75) Inventor: William E. Allen, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 221 days.

(21) Appl. No.: 10/000,285

(22) Filed: Nov. 30, 2001

(65) Prior Publication Data

US 2003/0102974 A1 Jun. 5, 2003

(51) Int. Cl.[7] ..... G08B 21/00

(52) U.S. Cl. ..... 340/686.6; 340/539.13; 340/825.49; 340/988

(58) Field of Search ..... 340/686.6, 686.5, 340/825.49, 988, 539.13

(56) References Cited

U.S. PATENT DOCUMENTS

| | | | | |
|---|---|---|---|---|
| 5,461,365 A | | 10/1995 | Schlager et al. | |
| 5,552,772 A | | 9/1996 | Janky et al. | |
| 5,760,742 A | | 6/1998 | Branch et al. | |
| 5,793,882 A | | 8/1998 | Piatek et al. | |
| 5,886,667 A | | 3/1999 | Bondyopadhayay | |
| 5,923,294 A | | 7/1999 | Bacelon et al. | |
| 5,982,281 A | | 11/1999 | Layson, Jr. | |
| 5,987,379 A | | 11/1999 | Smith | |
| 6,014,080 A | | 1/2000 | Layson, Jr. | |
| 6,169,497 B1 | | 1/2001 | Robert | |
| 6,181,272 B1 | | 1/2001 | Kirk | |
| 6,204,813 B1 | | 3/2001 | Wadell et al. | |
| 6,226,572 B1 | | 5/2001 | Tojima et al. | |
| 6,259,399 B1 | | 7/2001 | Krasner | |
| 6,265,974 B1 | * | 7/2001 | D'Angelo et al. | 340/568.1 |
| 6,268,804 B1 | | 7/2001 | Janky et al. | |
| 6,292,725 B1 | | 9/2001 | Kageyama et al. | |
| 2002/0175825 A1 | * | 11/2002 | Clerk et al. | 340/686.6 |
| 2002/0190861 A1 | * | 12/2002 | Wentworth | 340/568.1 |

FOREIGN PATENT DOCUMENTS

| | | |
|---|---|---|
| DE | 19914906 | 5/2000 |
| JP | 08201080 | 9/1996 |
| JP | 11195196 | 7/1999 |
| JP | 2001116564 | 4/2001 |

* cited by examiner

*Primary Examiner*—Anh V. La
(74) *Attorney, Agent, or Firm*—Steve Lundquist

(57) ABSTRACT

A method and apparatus for tracking the location of an object near a machine at a site. The method and apparatus includes determining a position of the machine, determining a position of the object, transmitting the determined position of the object from the object to the machine, and displaying the position of the object relative to the position of the machine to an operator of the machine.

35 Claims, 4 Drawing Sheets

100
102
106
228
218
207
230
ID
212
202
GPS
TX
RX
204
214
216
104
203
GPS
DGPS
226
TX
RX
206
222
224
220
210
208
CONTROLLER
DISPLAY

METHOD AND APPARATUS FOR TRACKING OBJECTS AT A SITE

TECHNICAL FIELD

This invention relates generally to a method and apparatus for tracking the location and movement of persons and objects in the vicinity of a machine at a site and, more particularly, to a method and apparatus for providing a display to a machine operator of the location and movement of persons and objects in the vicinity of the machine.

BACKGROUND

Sites such as work sites often have much activity taking place. In many instances, work sites include machines, such as mobile machines, which perform work functions. In addition, these work sites typically include the movement of vehicles and persons in the vicinity of these machines, and all movement must be coordinated to avoid interference between machines, vehicles, and persons.

For example, in an open pit mining site, large work machines such as off-highway trucks, large wheel loaders, large track-type tractors, excavators, and the like, perform work functions such as digging, dozing, hauling, and such. In addition, other vehicles, such as supervisors' trucks, service vehicles, site visitors' vehicles, and the like, must often travel about the site in the vicinity of the work machines. Furthermore, persons, e.g., workers, service and repair persons, supervisors, and such, often need to move about the site for various reasons.

An operator of a work machine must be constantly aware of this movement of persons, machines, and vehicles, particularly in the immediate area in which the operator is controlling the work machine. However, the operator must also focus on the work being performed. In the situation in which the work machine is quite large, for example a large mining machine, it becomes very difficult, if not impossible, to maintain a full awareness of the activities at the site.

The present invention is directed to overcoming one or more of the problems as set forth above.

SUMMARY OF THE INVENTION

In one aspect of the present invention a method for tracking the location of an object near a machine at a site is disclosed. The method includes the steps of determining a position of the machine, determining a position of the object, transmitting the determined position of the object from the object to the machine, and displaying the position of the object relative to the position of the machine to an operator of the machine.

In another aspect of the present invention an apparatus for tracking the location of an object near a machine at a site is disclosed. The apparatus includes a first position determining system located on the object, a first transmitting and receiving system located on the object, a second transmitting and receiving system located on the machine, a display located on the machine, and a controller located on the machine, wherein the controller receives position information of the object transmitted from the first transmitting and receiving system to the second transmitting and receiving system, and responsively provides information to the display to indicate the location and movement of the object relative to the machine.

In yet another aspect of the present invention a method for providing a machine with the location and movement of an object near the machine at a site is disclosed. The location and movement of the object is determined by the object. The method includes the steps of receiving a global positioning satellite (GPS) signal, determining a position of the object as a function of the GPS signal, transmitting the determined position to the machine, and transmitting an identification code to the machine.

DETAILED DESCRIPTION

Figure 1:
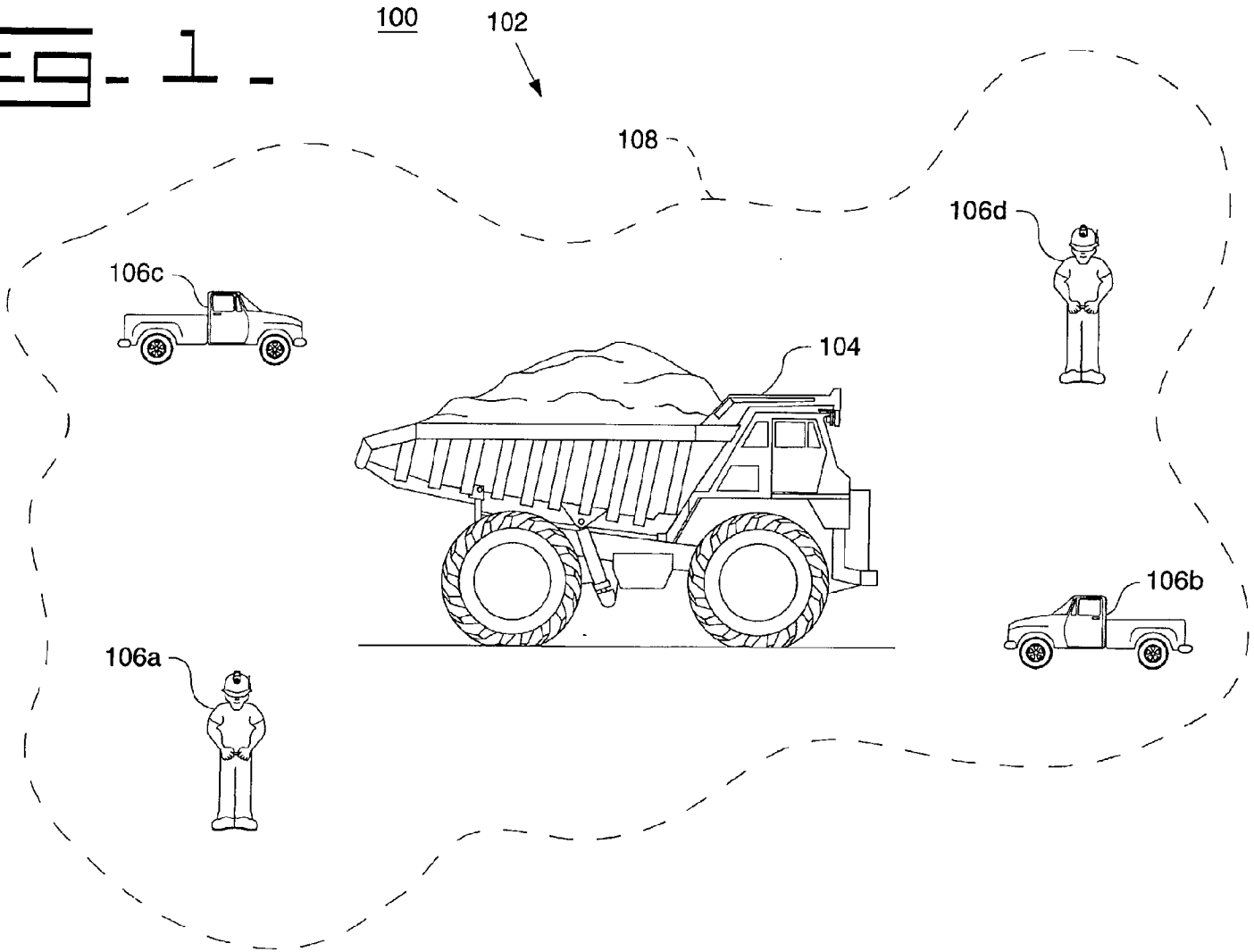
FIG. 1 is a diagrammatic illustration of a site having a machine and a plurality of objects such as would be suited for use with the present invention.

Referring to the drawings and the appended claims, a method and apparatus 100 for tracking the location and movement of an object 106 near a machine 104 at a site 102 is described.

With particular reference to FIG. 1, the site 102 is depicted as a mining or construction site. However, it is noted that the site may be any other site in which application of the present invention is suitable. For example, a manufacturing facility, a warehouse, a general area of heavy vehicular and pedestrian traffic are a few examples of sites which can benefit from the present invention.

The machine 104 in FIG. 1 is shown as a mobile machine, more particularly, a large off-road mining truck in this example. Off-road mining trucks, due to their very large size compared to other vehicles and persons in the vicinity, are particularly well suited to benefit from the present invention. Other types of large mobile machines commonly found at mining sites would benefit as well. For example, large wheel loaders, excavators, front shovels, track-type tractors, motor graders, scrapers, and such, may utilize the present invention to their benefit.

Furthermore, other types of machines at other types of sites can utilize the present invention. For example, a tele-handler machine at a warehouse or storage site, a material handling machine at a manufacturing plant, and such, may be used with the present invention.

In the preferred embodiment, the site 102 also includes one or more objects 106. An object 106 is defined by an ability to move about the site 102. Thus, the object 106 must move about the site 102 in cooperation with the machine 104. Preferably, two types of objects 106 maybe located at the site 102.

The object 106 may be a person, shown in FIG. 1 as 106*a,d*. Alternatively, the object 106 may be a mobile vehicle, such as a pickup truck, shown in FIG. 1 as 106*b,c*. It is noted that the object 106 may be of some other type without deviating from the spirit of the present invention. For example, the object 106 may be a mobile robot, a remotely controlled mobile device, or even another machine 104.

In the example illustrated in FIG. 1, and used to describe the present invention in more detail below, the machine 104, depicted as an off-road mining truck, is much larger in size than any of the objects 106*a,b,c,d*. Thus, it becomes difficult for an operator of the machine 104 to maintain a full awareness of the location and movement of the objects 106, as the machine 104 and the objects 106 move about the site 102. It is noted that the term "location" is used in the description below interchangeably with the term "position" to denote a location, preferably in geographical coordinates, of the machine 104 and each of the objects 106.

Figure 2:
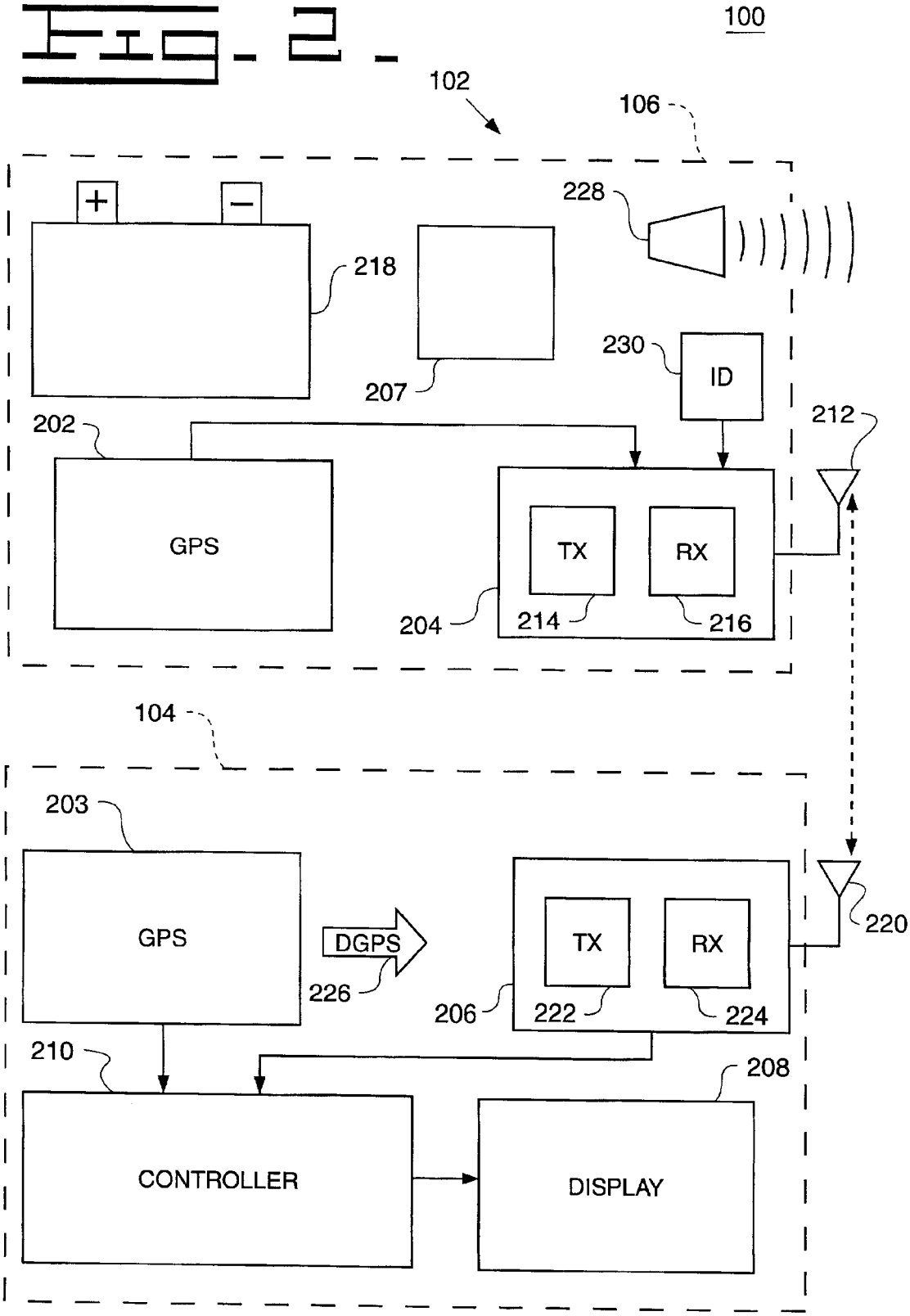
FIG. 2 is a block diagram illustrating a preferred embodiment of the present invention.

Referring to FIG. 2, and with continued reference to FIG. 1, a block diagram illustrating a preferred embodiment of the present invention is shown. The block diagram of FIG. 2 shows one machine 104 and one object 106. However, any number of machines 104 or objects 106 may be used, without deviating from the present invention, by merely duplicating sets of block diagrams.

In the preferred embodiment, the object 106 includes a variety of elements which, due to the mobile nature of the object 106, are designed for portable use. For example, if the object 106 is a person, the various elements described below must be carried on that person as the person moves about the site 102. Furthermore, the elements, being electrical and electronic in nature, must be provided with power from a portable power source, as described below. The various pieces of equipment described below which are carried on the person must be small and lightweight to avoid interfering with the routine tasks which must be performed by the person. Thus, the equipment may be located on the person's hardhat, on a vest, on a backpack, or some other such arrangement. FIG. 1 depicts a preferred embodiment in which the equipment is mounted on a hard hat.

If the object 106 is a mobile vehicle, such as the pickup trucks shown in FIG. 1, the elements are preferably configured to be portable to easily locate on the mobile vehicle when it enters the site 102. For example, a service person's truck, a foreman's truck, a visitor's truck, and the like, may only enter the site 102 from time to time as needed. In the preferred embodiment, when a mobile vehicle enters the site 102, the below-described equipment, configured as one mobile unit, is placed in the mobile vehicle for use during the time in which the mobile vehicle is at the site 102.

A preferred, but not necessarily all-inclusive, description of the equipment located on the object 106 includes the following.

A first position determining system 202 determines the position, preferably in geographical coordinates, of the object 106. In the preferred embodiment, the first position determining system 202 includes a global positioning satellite (GPS) system.

A first transmitting and receiving system 204, preferably a close range, e.g., about 100 meters, system, includes an antenna 212, a transmitter 214, and a receiver 216. An example of a transmitting and receiving system 204 suitable for use is an enhanced bluetooth transceiver, which is well known in the art.

A back-up alarm 228, preferably an audible alarm, is used to indicate to the object 106 when the machine 104 is backing up in the vicinity of the object 106, as is explained in more detail in the continuing description below.

A power source 218, preferably a battery, provides electrical power to the first position determining system 202, the first transmitting and receiving system 204, and the back-up alarm 228. If the object 106 is a mobile vehicle, the power source 218 may be connected to and transportable with the equipment or, alternatively, may be a suitable device for connecting to the power source of the mobile vehicle. For example, a connector suited for plugging into an available DC outlet.

A means 230 for generating an identification (ID) code provides an ID code which is unique for the object 106. For example, the ID code may determine the object to be a person or a mobile vehicle. Furthermore, the ID code may determine who the person is or which mobile vehicle is present. Optionally, the ID code may include additional information, such as the reason for the object 106 being at the site 102, a listing of locations for which the object 106 is authorized to be present, and the like. The means 230 for generating the ID code may be a microprocessor (not shown) located on the object 106, a discrete electronic circuit, a plug-in chip, or some other such device suitable for providing the unique ID code.

The machine 104 preferably includes a variety of equipment located thereon, as shown in FIG. 2. A preferred, but not necessarily all-inclusive, description of the equipment located on the machine 104 includes the following.

A second transmitting and receiving system 206 preferably includes at least one antenna 220, a transmitter 222 and a receiver 224. Since the machine 104, such as the off-road mining truck shown in FIG. 1, may be very large in size, it may be desired to include more than one antenna 220 located on the machine 104 such that communications between the machine 104 and the object 106 are allowed for any location of the object 106 near the machine 104. For example, an antenna 220 mounted on top of the machine 104 may not be suitable for communicating with an object 106 which is located extremely close to, or even underneath, the machine 104. It may be desired to mount a second antenna 220 underneath the machine 104. In the preferred embodiment, the second transmitting and receiving system 206 is fully compatible for communicating with the first transmitting and receiving system 204. The machine 104 may include an additional transmitting and receiving system (not shown) for providing communications between the machine 104 and either a remote site, such as an office, or other machines.

Furthermore, the object 106 may include a third transmitting and receiving system 207 capable of longer range transmissions than the first transmitting and receiving system 204. In a preferred embodiment, the third transmitting and receiving system 207 may receive information from the first transmitting and receiving system 204 and responsively relay the information to a more distant location, such as a remotely located office, or to other machines. The remote site could then monitor the locations and activities of objects 106 and machines 104 throughout the site 102. Preferably, the first transmitting and receiving system 204 is located at a first position on the object 106, such as on a hardhat of a person, and the third transmitting and receiving system 207 is located at a second position on the object 106, such as on a belt worn by the person.

A second position determining system 203 determines the position, preferably in geographical coordinates, of the machine 104. In the preferred embodiment, the second position determining system 203 includes a global positioning satellite (GPS) system. It is typical for GPS systems to include some error in position determinations caused by a number of factors. For example, GPS signal propagation delays, inaccuracies in pseudorange estimates, and the like, contribute to inaccuracies which may affect the position determination by as much as several meters. However, the errors would tend to be consistent in the first and second position determining systems 202,203.

Therefore, the determined position of the object 106 relative to the determined position of the machine 104 would tend to be much more accurate than either determined position alone, i.e., an enhanced relative accuracy. Alternatively, the second position determining system could includes means 226 for delivering a differential global positioning system (DGPS) signal to the object 106. The DGPS signal allows the object 106 to determine position with respect to the machine 104 with much greater accuracy. Differential global positioning systems are well known in the art and will not be described further.

A controller 210 receives position information of the object 106 transmitted from the first transmitting and receiving system 204 to the second transmitting and receiving system 206, and responsively provides information to a display 208 to indicate the location and movement of the object 106 relative to the machine 104. The display 208, located on the machine 104, preferably provides a mapped view of the location and movement of the machine 104, and the location and movement of any objects 106 located near the machine 104, to an operator of the machine 104. Furthermore, the display 208, in the preferred embodiment, provides a visual indication of the unique ID code associated with the object 106. The controller 210 is preferably microprocessor based.

Figure 3:
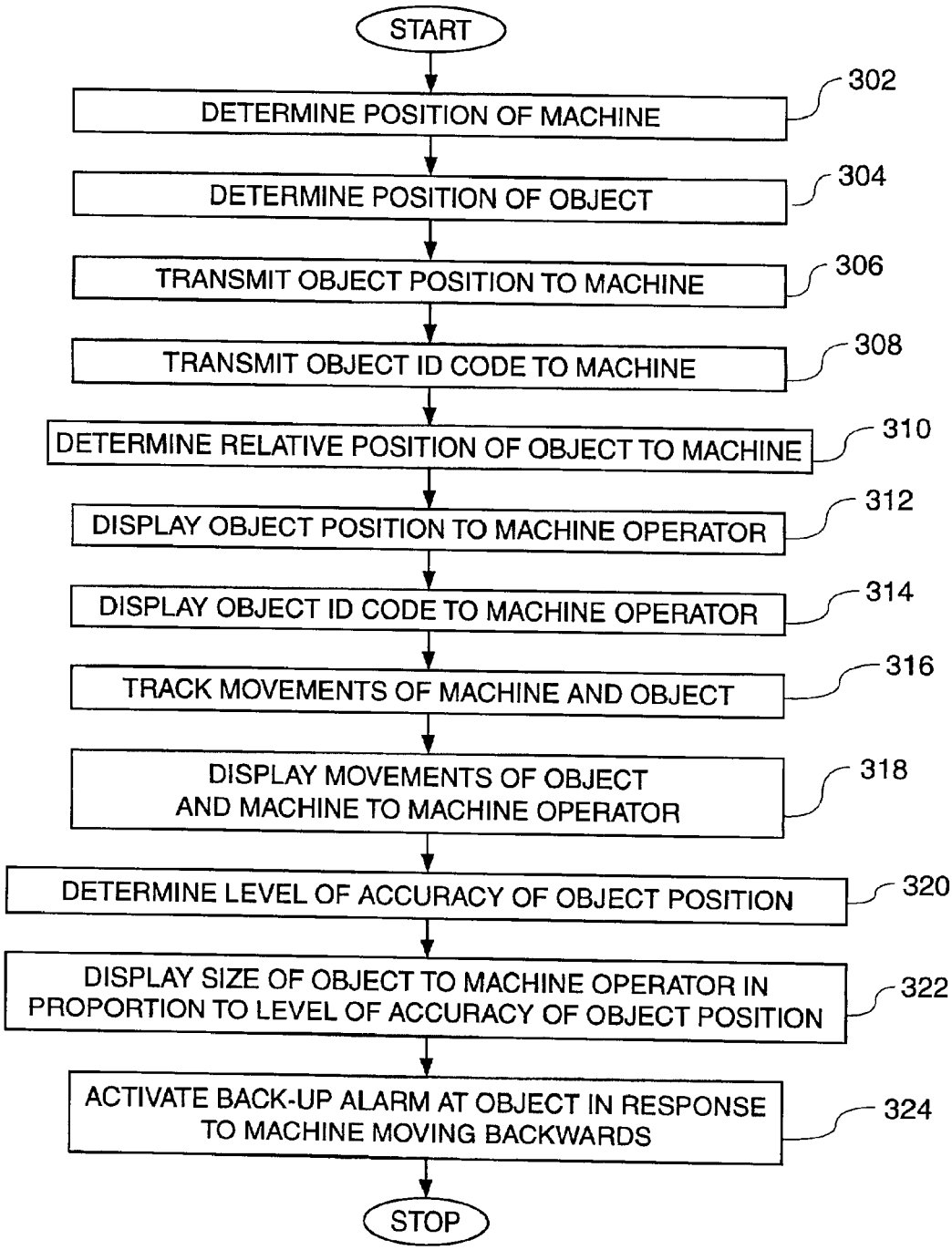
FIG. 3 is a flow diagram illustrating a first aspect of the present invention.

Referring to FIG. 3, a flow diagram illustrating a first embodiment of a preferred method of the present invention is shown.

In a first control block 302, the position of the machine 104 is determined. Preferably, the position of the machine 104 is determined in geographical coordinates by use of the second position determining system 203, e.g., a GPS system, located on the machine 104.

In a second control block 304, the position of the object 106 is determined. Preferably, the position of the object 106 is determined in geographical coordinates by the use of the first position determining system 202, e.g., a GPS system, located on the object 106.

In a third control block 306, the position of the object 106 is transmitted to the machine 104. In the preferred embodiment, the transmittal is accomplished by use of the first transmitting and receiving system 204 located on the object 106, and by use of the second transmitting and receiving system 206 located on the machine 104.

In a fourth control block 308, an identification (ID) code is transmitted from the object 106 to the machine 104, also preferably by use of the first and second transmitting and receiving systems 204,206. The ID code may contain information identifying the object 106 as a person or a mobile vehicle. Further, the ID code may specifically identify the person or mobile vehicle. The ID code may contain any additional information desired for the application used.

In a fifth control block 310, the relative position of the object 106 to the position of the machine 104 is determined, preferably by comparing the determined positions which would tend to contain errors which are the same. Thus, the errors, as described above, would have minimal effect since the positions of the object 106 and the machine 104 are compared in a relative manner.

In a sixth control block 312, the position of the object 106, as transmitted to the machine 104, is displayed to an operator of the machine 104. Preferably, the display 208 indicates the machine 106 at the center upon determination of the geographical position of the machine 104, and indicates the object 106, and any additional objects 106, as their positions would place them relative to the machine 104. The display 208 then allows the operator an enhanced awareness of the location of objects 106 near the machine 104.

In a seventh control block 314, the ID code of the object 106 is indicated on the display 208. The ID code may be displayed by any of a number of methods. For example, icons unique to specific ID codes may be used. Alternatively, the ID information may be displayed as text, or some combination of graphical and text displays.

In an eighth control block 316, the movements of the machine 104 and the object 106 are tracked. In the preferred embodiment, the movements are determined by successive position determinations. Information such as direction of travel and speed of travel may be determined. Preferably, the movement of the object 106 is determined relative to the movement of the machine 104.

In a ninth control block 318, the movements of the machine 104 and the object 106 are indicated on the display 208. The preferred method of indicating the relative movements is to maintain an image of the machine 104 at the center of the display 208 and to indicate the movement of all objects 106 relative to the machine 104. However, the display 208 may alternatively show movement of the machine 104 and all objects 106, for example maintaining the image relative to another fixed point, such as a landmark at the site 102.

In a tenth control block 320, a level of accuracy of the determined position of the object 106 is determined. For example, using a GPS system, it may be determined that position accuracy is diminished by an obscured line of sight to a minimum number of GPS satellites, such as, for example, along a face of a cliff. As another example, it may be determined that the type of object 106 necessitates a more accurate position determination. For example, it may be desired to determine the position of a person more accurately than the position of a mobile vehicle.

In an eleventh control block 322, the size of the display of the object 106 is increased in proportion to a decrease in the level of accuracy of the position determination of the object 106. Preferably, an icon depicting the object 106 is enlarged in response to determining that the position of the object 106 has been determined with reduced accuracy. The result is that a variable buffer zone is created around the object 106 to compensate for the uncertainty of the position of the object 106.

In a twelfth control block 324, a back-up alarm 228 located at the object 106 is activated in response to the machine 104 moving in a backwards direction. Back-up alarms are commonly used with mobile machines, such as mining, construction, haulage machines, and the like. Typically, a system located on the mobile machine determines that the machine is backing up, and an audible alarm located on the machine itself is activated. For example, activation of a back-up light, a change in transmission to a reverse gear, and the like, may activate the alarm. The present invention, however, differs in that the audible alarm is located on the object 106 rather than the machine 104. In the preferred embodiment, the controller 210 on the machine 104 determines that an object 106 is or could be in the path of the machine 104 as it travels backwards. The machine 104 then transmits a signal to the object 106 to activate the back-up alarm 228 on the object 106. Thus, the object 106 is notified directly that a nearby machine 104 may be moving toward the object 106 in a reverse direction. The present invention offers the specific advantage of a targeted back-up alarm that only activates as needed.

Figure 4:
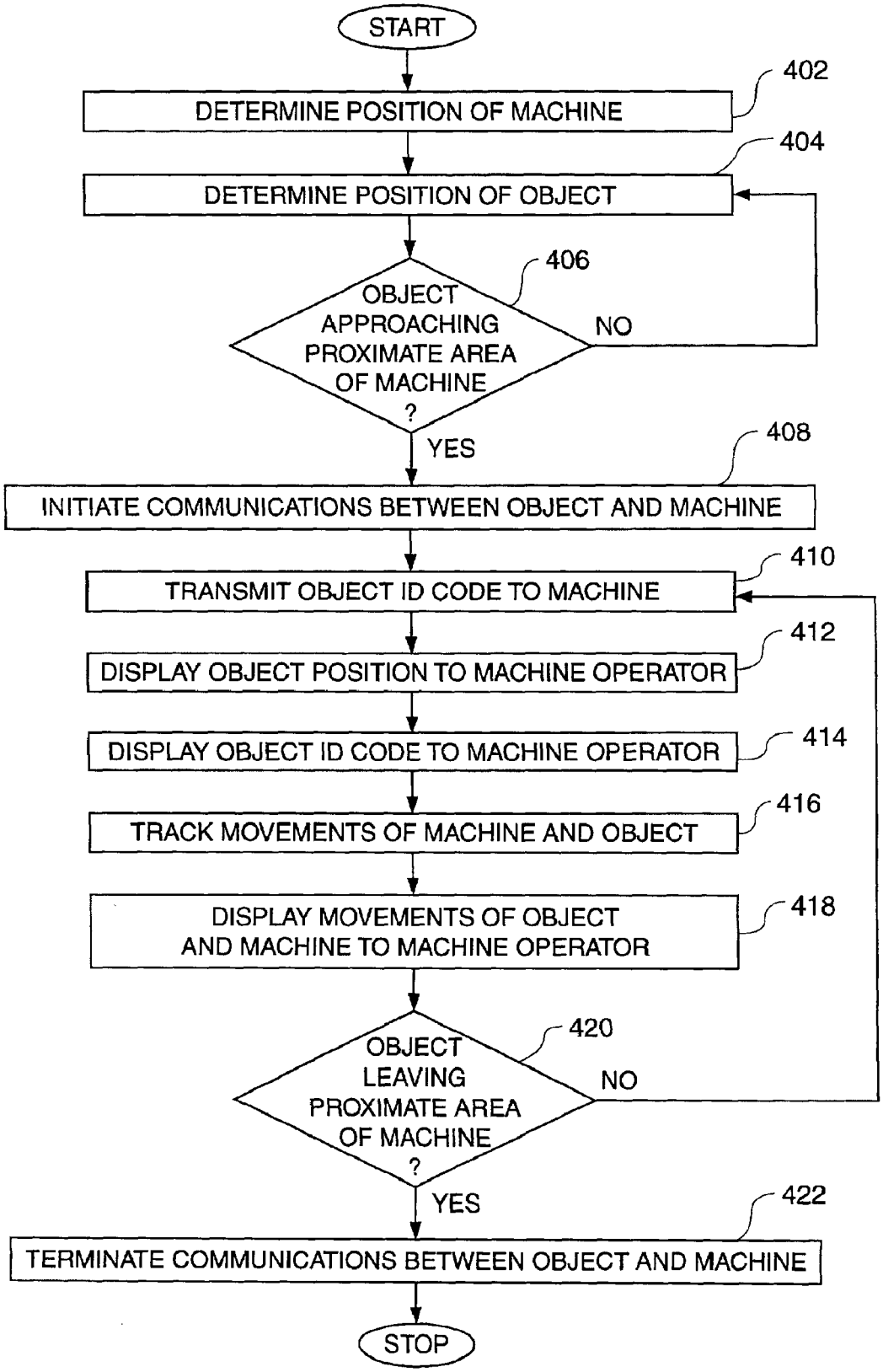
FIG. 4 is a flow diagram illustrating a second aspect of the present invention.

Referring to FIG. 4, an alternative embodiment of the preferred method of the present invention is shown in a flow diagram.

In a first control block 402, the position of the machine 104 is determined, as described above. In a second control block 404, the position of the object 106 is determined, as described above.

In a first decision block 406, based on the determined positions of the machine 104 and the object 106, it is determined whether the object 106 is approaching a proximate area 108 of the machine 104. In the preferred embodiment, the proximate area 108 is defined by the transmitting range of the first transmitting and receiving system 204. For example, if the first transmitting and receiving system 204 has a range of about 100 meters, as described above, the proximate area 108 is defined as about 100 meters from the machine 104. Alternatively, the proximate area 108 may be a predetermined distance from the machine 104, based on such parameters as the size of the machine 104, the speed of movement of the machine 104, the level of visibility of the surrounding area to an operator of the machine 104, and the like.

In a third control block 408, communications are initiated between the object 106 and the machine 104 in response to determining that the object 106 is entering the proximate area 108 of the machine 104. The communications are initiated for purposes such as, but not necessarily limited to, those described above.

In a fourth control block 410, the ID code is transmitted from the object 106 to the machine 104. In a fifth control block 412, the position of the object 106 is displayed to the operator of the machine 104. In a sixth control block 414, the ID code of the object 106 is displayed to the operator of the machine 104. In a seventh control block 416, the movements of the machine 104 and the object 106 are tracked. In an eighth control block 418, the movement of the object 106 relative to the movement of the machine 104 is displayed to the operator of the machine 104. All of the above steps in the fourth through eighth control blocks 410–418 are performed as described above with respect to the same steps depicted in the flow diagram of FIG. 3.

In a second decision block 420, it is determine whether the object 106 is leaving the proximate area 108 of the machine 104. For example, if the proximate area 108 is defined by the transmitting range of the first transmitting and receiving system 204, and the object 106 is determined to be leaving the transmitting range, the object 106 may be assumed to be leaving the proximate area 108. However, differentiation must be made between leaving the proximate area 108 due to moving beyond the transmitting range and no longer being in transmitting range due to obstruction of the communications signal. For example, if the object 106 has moved into a position, e.g., too close to the machine or behind an obstacle, that prevents communications from taking place, the object 106 is still considered to be within the proximate area 108. Under these circumstances, it may be desired to take additional measures, such as stopping the machine 106 or alerting the operator of the machine 104, until the position of the object 106 relative to the machine 104 can be more readily determined.

In a ninth control block 422, communications are terminated between the object 106 and the machine 104 in response to the object 106 leaving the proximate area 108.

Industrial Applicability

As an example of an application of the present invention, mining sites, for example open pit mining sites, include a variety of activity moving about the site. Large mobile mining machines, such as off-road mining trucks, excavators, wheel loaders, track-type tractors, and the like, are constantly moving about their respective work areas at the mining site performing work functions. Smaller mobile vehicles, such as maintenance trucks, supervisors' trucks, visitors' vehicles, and the like, often move about the same vicinity as the large mining machines. Persons, for example, individual workers, supervisors, maintenance persons, and the like, also move about in the vicinity of the large mining machines. The very large size of the mining machines as compared to the size of the mobile vehicles and persons makes it very difficult for an operator of a mining machine to keep track of the locations and movements of the mobile vehicles and persons. The present invention provides a method and apparatus for the locations and movements of the mobile vehicles and persons in the vicinity of a mining machine to be tracked and displayed to the operator of the mining machine.

Other aspects, objects, and features of the present invention can be obtained from a study of the drawings, the disclosure, and the appended claims.

What is claimed is:

1. A method for tracking the location and movement of an object near a machine at a site, including the steps of:

determining a position of the machine using a position determining system located on the machine;

determining a position of the object using a position determining system located on the object;

transmitting the determined position of the object from the object to the machine; and displaying the position of the object relative to the position of the machine to an operator of the machine.

2. A method, as set forth in claim 1, further including the step of transmitting an identification code of the object from the object to the machine.

3. A method, as set forth in claim 2, further including the step of displaying an identification of the object to the operator of the machine.

4. A method, as set forth in claim 2, further including the step of identifying the object as being one of a person and a mobile vehicle.

5. A method, as set forth in claim 1, further including the steps of:

tracking the movements of the machine and the object relative to the machine; and displaying the movements of the machine and the object to the operator of the machine.

6. A method, as set forth in claim 1, further including the step of transmitting a differential global positioning satellite (DGPS) signal from the machine to the object, and wherein the object receives the DGPS signal and responsively determines the position of the object.

7. A method, as set forth in claim 1, further including the step of notifying the operator of the machine in response to an other object approaching a proximate area in which the machine is located.

8. A method, as set forth in claim 7, further including the steps of:

determining a position of the other object;

transmitting the position and an identification code of the other object from the other object to the machine; and displaying the position and the identification of the object and the other object relative to the position of the machine to the operator of the machine.

9. A method, as set forth in claim 8, further including the step of transmitting the positions and the identification codes of the object and the other object from the machine to at least one of an other machine and a remote site.

10. A method, as set forth in claim 1, further including the steps of:

determining a level of accuracy of the determined position of the object; and increasing a size of a display of the object to the operator of the machine in proportion to a decrease in the level of accuracy of the determined position.

11. A method, as set forth in claim 1, further including the step of notifying the operator of the machine in response to a decrease in a level of confidence of the determined location of the object.

12. A method, as set forth in claim 8, further including the step of removing the display of the position of the other object in response to the other object leaving the proximate area.

13. A method, as set forth in claim 1, further including the step of activating a back-up alarm located on the object to indicate a condition of the machine moving in a backwards direction.

14. An apparatus for tracking the location and movement of an object near a machine at a site, comprising:

a first position determining system located on the object;

a first transmitting and receiving system located on the object;

a second transmitting and receiving system located on the machine;

a display located on the machine; and a controller located on the machine;

wherein the controller receives position information of the object transmitted from the first transmitting and receiving system to the second transmitting and receiving system, and responsively provides information to the display to indicate the location and movement of the object relative to the machine.

15. An apparatus, as set forth in claim 14, wherein the object is a person.

16. An apparatus, as set forth in claim 14, wherein the object is a mobile vehicle.

17. An apparatus, as set forth in claim 14, wherein the object includes a plurality of objects, including at least one of a plurality of persons, a plurality of mobile vehicles, and a combination of persons and mobile vehicles.

18. An apparatus, as set forth in claim 14, wherein the machine is a work machine adapted to move about the site.

19. An apparatus, as set forth in claim 14, wherein the first position determining system includes a global positioning satellite (GPS) system.

20. An apparatus, as set forth in claim 14, wherein the object is a person, the first position determining system includes a global positioning satellite (GPS) system, and the first transmitting and receiving system includes at least one antenna, a transmitter, and a receiver; and further including a power source located on the person; wherein the GPS system, the first transmitting and receiving system, and the power source are portable units located on the person as the person moves about the site.

21. An apparatus, as set forth in claim 14, wherein the object is a mobile vehicle, the first position determining system includes a global positioning satellite (GPS) system, and the first transmitting and receiving system includes at least one antenna, a transmitter, and a receiver; and further including a power source located on the mobile vehicle; wherein the GPS system, the first transmitting and receiving system, and the power source are portable units located on the mobile vehicle as the mobile vehicle moves about the site.

22. An apparatus, as set forth in claim 18, further including a second position determining system located on the machine.

23. An apparatus, as set forth in claim 22, wherein the second position determining system is a global positioning satellite (GPS) system, and wherein the machine further includes a means for delivering a differential global positioning satellite (DGPS) signal to the object.

24. An apparatus, as set forth in claim 14, further including means for generating an identification code for the object.

25. An apparatus, as set forth in claim 18, wherein the second transmitting and receiving system includes at least one antenna located on the machine such that communications between the machine and the object are allowed for any location of the object near the machine.

26. An apparatus, as set forth in claim 18, further including a back-up alarm located on the object to indicate a condition of the machine moving in a backwards direction.

27. An apparatus, as set forth in claim 14, wherein the first transmitting and receiving system is a short-range system, and further including a third transmitting and receiving system located on the object, the third transmitting and receiving system being a long-range system.

28. A method for tracking the location and movement of an object near a machine at a site, including the steps of:

determining a position of the machine using a position determining system located on the machine;

establishing a proximate area in which the machine is located;

determining a position of the object using a position determining system located on the object;

transmitting the determined position of the object from the object to the machine;

determining the object to be approaching the proximate area; and displaying the position of the object relative to the position of the machine to an operator of the machine.

29. A method, as set forth in claim 28, further including the steps of:

determining the object to be leaving the proximate area; and removing the display of the object.

30. A method for tracking the location and movement of an object near a machine at a site, including the steps of:

determining a position of the machine using a position determining system located on the machine;

determining a position of the object using a position determining system located on the object, the object being one of a person and a mobile vehicle;

transmitting the determined position of the object from the object to the machine;

transmitting an identification code of the object from the object to the machine; and displaying the position of the object relative to the position of the machine and the identification code of the object to an operator of the machine.

31. An apparatus for tracking the location and movement of a person near a machine at a site, comprising:

a first position determining system located on the person;

a second position determining system located on the machine;

a first transmitting and receiving system located on the person;

a second transmitting and receiving system located on the machine;

a display located on the machine; and a controller located on the machine;

wherein the controller receives position information and an identification code from the person transmitted from the first transmitting and receiving system to the second transmitting and receiving system, and responsively provides information to the display to indicate the location and movement of the person relative to the machine, and to further indicate the identification code of the person.

32. An apparatus for tracking the location and movement of a mobile vehicle near a machine at a site, comprising:

a first position determining system located on the mobile vehicle;

a second position determining system located on the machine;

a first transmitting and receiving system located on the mobile vehicle;

a second transmitting and receiving system located on the machine;

a display located on the machine; and a controller located on the machine;

wherein the controller receives position information and an identification code from the mobile vehicle transmitted from the first transmitting and receiving system to the second transmitting and receiving system, and responsively provides information to the display to indicate the location and movement of the mobile vehicle relative to the machine, and to further indicate the identification code of the mobile vehicle.

33. An apparatus, as set forth in claim 32, wherein the first position determining system and the first transmitting and receiving system are portably located on the mobile vehicle in response to the mobile vehicle entering the site.

34. A method for tracking the location and movement of an object near a machine at a site, including the steps of:

determining a position of the machine using a position determining system located on the machine;

determining a position of the object using a position determining system located on the object;

initiating communications between the object and the machine in response to the object approaching a proximate area in which the machine is located;

displaying the position of the object relative to the position of the machine to an operator of the machine; and terminating communications between the object and the machine in response to the object leaving the proximate area.

35. A method, as set forth in claim 34, further including the steps of:

communicating an identification code from the object to the machine; and displaying the identification code to the operator of the machine.

* * * * *